United States Patent [19]

Sobota

[11] 4,016,030

[45] Apr. 5, 1977

[54] CALENDERING PAPER CONTAINING THERMOPLASTIC CONTAMINANTS

[75] Inventor: John T. Sobota, Green Bay, Wis.

[73] Assignee: Fort Howard Paper Company, Green Bay, Wis.

[22] Filed: Jan. 8, 1976

[21] Appl. No.: 647,457

Related U.S. Application Data

[63] Continuation-in-part of Ser. No. 545,166, Jan. 29, 1975, abandoned.

[52] U.S. Cl. ..... 162/199; 100/38; 100/93 RP; 162/206; 162/359

[51] Int. Cl.[2] ..... D21F 5/06; D21F 9/02

[58] Field of Search ..... 162/199, 206, 207, 272, 162/280, 281, 282, 290, 305, 358, 359, 360 R, 4, 13, 111, 113; 100/38, 93 RP, 161, 176; 34/18, 41, 61, 62, 116, 152

[56] References Cited

UNITED STATES PATENTS

| | | | |
|---|---|---|---|
| 680,135 | 8/1901 | Drew et al. | 100/93 RP |
| 1,291,626 | 1/1919 | Parks | 100/38 |
| 1,326,615 | 12/1919 | Pope | 100/93 RP |
| 2,001,023 | 5/1935 | Howell et al. | 162/111 |
| 2,111,834 | 3/1938 | Berry | 162/199 |
| 2,378,113 | 6/1945 | Van De Carr, Jr. | 162/206 X |
| 2,908,964 | 10/1959 | Appenzeller | 100/93 RP |
| 2,981,175 | 4/1961 | Goyette | 100/93 RP |
| 3,082,683 | 3/1963 | Justus | 100/93 RP |
| 3,647,619 | 3/1972 | Mack et al. | 100/38 X |
| 3,957,573 | 5/1976 | Miyamoto et al. | 162/206 X |

FOREIGN PATENTS OR APPLICATIONS

| | | | |
|---|---|---|---|
| 314,937 | 11/1929 | United Kingdom | 162/207 |

*Primary Examiner*—S. Leon Bashore
*Assistant Examiner*—Richard V. Fisher
*Attorney, Agent, or Firm*—Barnes, Kisselle, Raisch & Choate

[57] ABSTRACT

A pulp slurry including pulp made from recycled waste paper is formed into tissue paper in a paper-making machine having an improved calender stack preceded by a conventional drying and creping section. Drying may be completed on a Yankee dryer or the drying may be partial on the Yankee and completed on so-called afterdryers. One or more rolls in the calender stack are cooled to about 90° F by passing liquid coolant therethrough to keep the paper at a temperature below the melting temperature of thermoplastic contaminants in the recycled waste paper so that the contaminants pass through the calender roll in a hardened, nonsticky or less sticky condition. The cooled calender roll is kept dry by an air shower. A continuous doctor on the cooled roll removes any contaminants that adhere to the roll.

30 Claims, 6 Drawing Figures

CALENDERING PAPER CONTAINING THERMOPLASTIC CONTAMINANTS

This application is a continuation-in-part of application Ser. No. 545,166, filed Jan. 29, 1975, now abandoned.

This invention relates to paper making and, more particularly, to an improvement in calendering paper that is made from recycled waste paper having thermoplastic contaminants.

When recycled waste paper is used in making paper, the waste paper is treated to remove such things as inks, coatings, fillers and other noncellulosics. Special care is also taken to keep certain waste paper products, such as self-sealing envelopes, out of the mixture. Nonetheless, treated waste paper may still contain thermoplastic contaminants which can cause trouble in various stages of a paper-making machine, particularly at the calender. The term "contaminants" as used in this application in reference to the thermoplastic remaining in the pulp made from recycled waste paper means 1 percent or less of thermoplastic, by weight on a dry basis, and usually less than one-half percent on a dry basis. Hence for a pulp slurry made from 100 percent recycled waste paper and typically 99 percent or greater water, the thermoplastic contaminants will be less than 0.01 percent at the greatest and typically less than 0.005 percent by weight of the slurry fed to the paper-making machine which, except for the calender, may be otherwise conventional and useful in making paper from pulp not having thermoplastic contaminants. Stated differently, the contaminants are less than 1 percent at the greatest and usually less than 0.5 percent of the substantially dry paper just prior to calendering. Thermoplastic contaminant content above about one-half percent or over 1 percent at the greatest severely impairs the quality of the paper made on conventional equipment and could not be tolerated. Hence the thermoplastic contaminants in the context of the present application are in contrast to plastic or resin intentionally included in the pulp mixture in substantial percentages, say 10 percent to 80 percent, for special paper-making processes where the complete process and equipment used therein is specially adapted to the plastic starting material. Such special processes are, for example, of the type shown in the United States Fridrichsen U.S. Pat. No. 3,101,294, granted Aug. 20, 1963, and the British Wade Pat. No. 314,937, accepted Nov. 28, 1929.

Although the thermoplastic contaminants do cause problems at locations other than at the calendering stack, these problems are less severe. For example, at the dryer, the temperatures are such that the contaminants may be sticky or even melted; but the moisture content of the paper is high and there is no nip contact at the dryer rolls. Since there is no nip at the dryer rolls, some plastic build-up on the dryer rolls can be tolerated and corrected by periodic cleaning.

However, the problems are greatly aggravated at the calender because the paper is dry and hot and is subjected to high nip pressures. The moisture content is, in the case of tissue paper, about 5 percent or less, but with heavier weight papers could be higher, up to say 8 or 10 percent. The calender usually runs relatively hot due to heat generated by friction in the calendering operation and heat that is brought to the calender from the dryer by the paper. For example, a typical dryer operation might be with steam at 280° F to 338° F, producing a surface temperature at the dryer rolls of 240° F to 290° F, and the dried paper might have a temperature of say 150° F to 200° F as it enters the calender from the dryer. Nip pressures are typically above 25 pounds per linear inch. All of these factors combine so that the thermoplastic contaminants, in a melted or sticky condition, tend to adhere to the calender roll. As the thermoplastics transfer to the calender roll, the plastic will build up on the roll creating an uneven surface. Because the plastic remains sticky on the roll, it is difficult to remove, as with a doctor blade, while the roll is rotating. An uneven calender roll surface, in turn, impairs the calendering functions and causes nonuniform paper thickness across the width of the paper. This is objectionable for obvious reasons that the desired characteristics are not fully achieved by the calendering; and, moreover, nonuniform paper thickness can cause breakage problems at later handling stages, for example, at continuous rewinders.

In the case of lightweight paper such as tissue, the problems are most aggravated. Particularly with lightweight paper such as tissue, breakage can also occur in the calender stack when the plastic adheres to the roll causing the paper to stick to the roll. In the case of tissue, most of the plastic in the sheet will be exposed at the surface due to the thinness of the paper and because the thermoplastic tends to form as surface spots on the top of the sheet. Hence most of the plastic in a tissue sheet will come in contact with the top calender roll or both top and bottom rolls. In a tissue sheet, the sticky plastic can laminate adjacent sheets together and cause breaks on the paper machine winder or in subsequent operations. Although the aforementioned problems have been tolerated, even though often severe at the calender, there is a manifest need to eliminate, or at least reduce, these problems without major and expensive modification of existing conventional paper-making lines.

Among the objects of the present invention are to provide a calender for a paper-making machine and a method of calendering paper that eliminate or at least substantially reduce the aforementioned problems caused by thermoplastic contaminants; that are relatively simple; and/or that can be implemented by only minor modification to conventional paper-making machinery.

Other objects, features and advantages of the present invention will become apparent in connection with the following description, the appended claims and the accompanying drawings in which:

Figure 1:
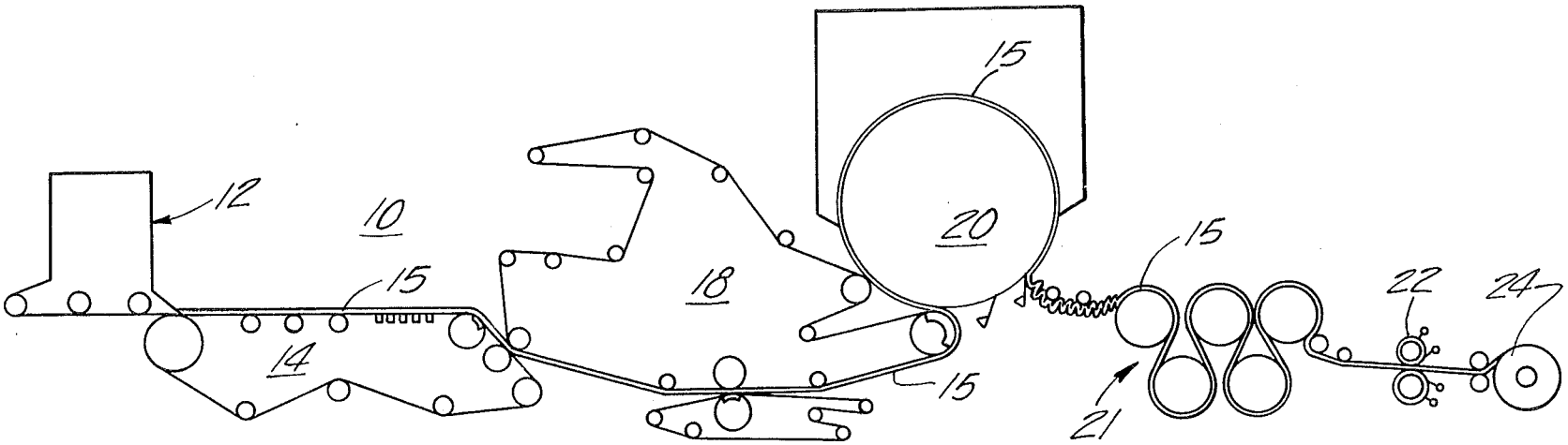
FIG. 1 is an elevational view schematically illustrating a paper-making machine.

Referring more particularly to FIG. 1, the paper-making machine 10 generally comprises a conventional head box 12 which feeds paper pulp to a wire 14 which felts the pulp into a continuous sheet 15 (shown in double lines) that is pressed in a press 18 and then partially dried and creped on a Yankee dryer 20. Drying is completed on an afterdryer 21. The dried sheet is then calendered in calender stack 22 and passed to a winder 24. Alternatively, drying could be completed on the Yankee dryer 20 to make what is called a dry crepe. In that case, the afterdryers 21 are eliminated so that the paper passes directly from the Yankee dryer 20 to calender 22 and then winder 24.

The present invention is directed to making paper on machine 10 using pulp made from recycled waste paper that includes thermoplastic contaminants, typically one-half percent or less by dry weight, but at the greatest up to about 1 percent. The present invention is particularly useful for, although not necessarily limited to, making lightweight paper, for example, tissue paper, wherein a creping operation is performed in the Yankee dryer 20 or the like prior to calendering. Most importantly, one of the principal aspects of the present invention is its incorporation into the calender of an otherwise conventional paper-making line, including, for example, where the paper is dried at dryer 20 by steam at say 280° F to 338° F. Hence the thermoplastic contaminants will have been heated in dryer 20 and/or afterdryer 21 to temperatures above their melting temperatures. After sheet 15 leaves dryer 20 and the afterdryers 21, the temperature of the sheet may be as high as 150° F to 200° F when it enters calender 22. Calender 22 would conventionally be operating at these temperatures and higher temperatures due to heat in the paper coming from the dryer 20 and heat generated by friction in the calender. At these temperatures, thermoplastic contaminants appear as small surface spots that are sticky, even if not molten, so that the plastic tends to adhere to the calender roll.

Figure 2:
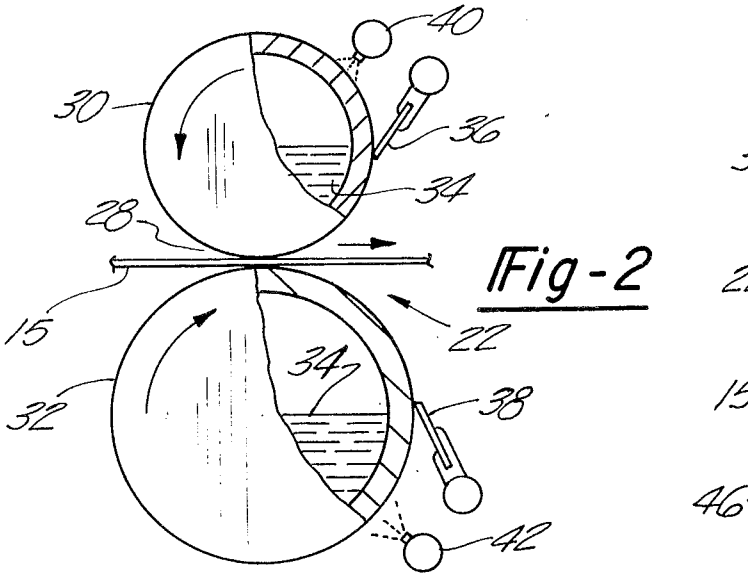
FIG. 2 is an enlarged elevational view of two rolls in the calender stack of the paper-making machine of FIG. 1, the rolls being partly broken away and in section to illustrate liquid coolant in the rolls.

Referring now to FIG. 2, according to an important aspect of the present invention, the calender stack 22 comprises an upper roll 30 and a lower roll 32 that form a nip 28 through which paper 15 passes from dryer 20 and afterdryer 21 in the case of wet crepe or directly from dryer 20 in the case of dry crepe. Rolls 30, 32 are cylindrical, hollow, made of iron or steel and cooled by liquid coolant indicated generally at 34 that is circulated through the rolls 30, 32 by suitable means (not shown). The cooled rolls 30, 32 cool paper 15 and hence any thermoplastic contaminants contained in the paper to eliminate or at least substantially reduce the likelihood that the plastic contaminants will stick to rolls 30, 32. Rolls 30, 32 are continuously doctored as by respective doctor blades 36, 38 that move slowly across the face of the associated roll. To this end, each doctor blade may be a straight blade that is slowly and continuously fed across the roll from a supply coil (not shown) to a take-up coil (not shown) at the opposite end of the roll. Doctor blades 36, 38 remove any thermoplastic contaminants that may be transferred to rolls 30, 32. Because rolls 30, 32 are cooled, the plastic contaminants will be in a hardened condition and easily scraped from the rolls by the doctor blades. Rolls 30, 32 are also dried by suitable means illustrated generally as a nozzle 40 for roll 30 and a nozzle 42 for roll 32. Depending on the temperature to which rolls 30, 32 are chilled and the ambient temperature and humidity, more or less air drying may be required to remove condensation from rolls 30, 32 and thus insure that moisture is not added to paper 15 during calendering.

Although the actual temperature to which rolls 30, 32 are cooled will vary depending on a number of factors, the present invention contemplates operating the rolls at a temperature low enough that most of the thermoplastic contaminants are not viscous, tacky or sticky and do not adhere to the rolls. Hence a surface temperature at the rolls 30, 32 of about 90° F would be satisfactory so that thermoplastic materials are hard and nonsticky as they pass through the calender rolls. It should be understood that the term "melting temperature" is used in this application in connection with the thermoplastic contaminants in a broad or general sense to mean the temperatures at which the plastics become sufficiently viscous, soft or sticky such that they adhere to the calender roll rather than the strict sense to mean the temperature at which the plastics change from solid to liquid state. In this regard, solvents used in de-inking of waste paper cause different thermoplastics with different melting points to agglomerate into a sticky mass of variable softening points. The melting temperature of the thermoplastic contaminants may also depend in part on the pressure at rolls 30, 32. In this regard, the present invention is characterized by pressures at nip 28 of at least 25 pounds per linear inch and usually higher. The upper temperature limit for rolls 30, 32 is determined according to the lowest melting temperatures of the thermoplastics contained in the recycled waste paper. Many thermoplastics or thermoplastic mixtures become sticky at temperatures of 150° F to 200° F, the temperature at which paper 15 enters a conventional calender stack. Hence for effective results, the highest temperature to which rolls 30, 32 might be cooled would be about 150° F, although a much lower temperature of say 90° F would be preferred, and a range of from 75° F to 150° F would be acceptable depending on other variables. The higher the temperature, the greater the likelihood that some thermoplastic contaminants will be in a sticky condition as they pass through the calender roll.

Although it might initially appear that rolls 30, 32 could be chilled or cooled to temperatures well below 90° F, a practical lower temperature limit is set by the dew point of the environment in which the rolls are operating. It is highly desirable that rolls 30, 32 be at a temperature above the dew point of the ambient environment to prevent or at least minimize condensation on the rolls. By operating at a temperature slightly above the dew point of the ambient air, for example, a temperature on the order of about 10° F above the dew point of the ambient air, condensation on the roll will be prevented. For example, on a very hot humid day, the dew point of the ambient air in the paper mill might be on the order of 70° F so that the rolls should not be operated at less than say 75° F to 80° F. Under usual conditions, creped tissue paper will have a moisture content of about 5 percent when it enters the calender. If tissue paper is calendered very much wetter than this, it will be too flat and there is a tendency for the paper to stick to the calender rolls. Of course, according to the present invention and depending upon the particular paper-making process to which it is applied, the moisture content could be up to 8 percent with an upper limit of say 10 percent. The noteworthy feature, however, is that the paper is substantially dry and hot when it enters the calender where it is subjected to high nip pressures. The moisture content is determined by the conventional process parameters prior to calendering and the moisture content is not changed at the calender when the present invention is used. Air drying by means of nozzles 40, 42 insures that condensed moisture, if any, is not added to the paper stock 15. By way of further illustration, in typical calendering of creped tissue paper (for example, tissue paper having a weight on the order of 9½ pounds per ream, 24 × 36 inches — 480 sheets), the pressure at rollers 30, 32 might be on the order of say 45 to 60 pounds per linear inch with a single nip calender stack 22. Calendering of such paper might be at speeds as low as 1000 feet per minute but more typically is at substantially higher speeds up to 5000 feet per minute.

Although the present invention is particularly useful for lightweight tissue, it is also useful on other creped paper, for example, papers having a weight in the range of from say 9 pounds per ream to about 35 pounds per ream. The present invention is also potentially useful with heavier and non-creped papers and with multiple roll or multiple nip calender stacks having nip pressures in a wider range of say 25 to 500 pounds per linear inch. Additionally, a minimum nip pressure of about 25 pounds per linear inch characterizes the calender as contrasted to other rolls in the paper-making line, for example, the aforementioned dryer rolls which do not have any nip pressure. When two or more nips are used, at least one roll at each nip or at least one roll at the first nip would be cooled. Lightweight tissue paper which has previously been creped is calendered primarily to soften the paper and, in general, only one nip, but sometimes two nips, are used. If two nips are used, both nips must be controlled separately in a conventional manner in order to compensate for elongation of the paper.

Figure 3:
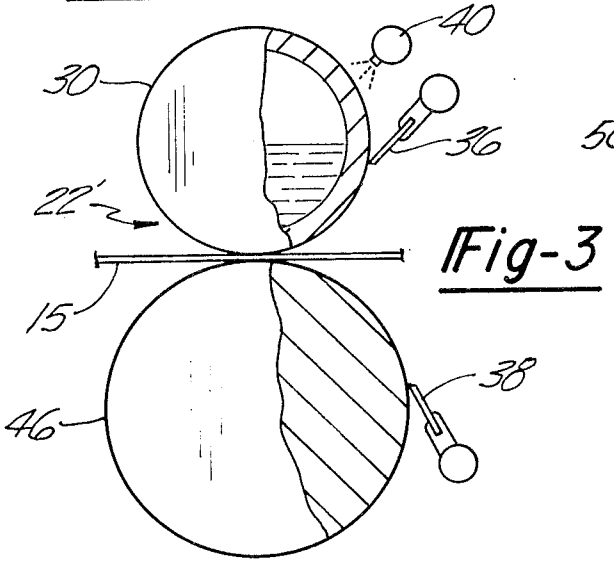
FIG. 3 is an elevational view, partly broken away and in section, of a modification in the calender rolls where only the upper roll is cooled.

Referring now to FIG. 3, the arrangement of the calender stack 22' is substantially the same as that described in connection with FIG. 2 except that the hollow bottom roll 32 in the calender stack 22 (FIG. 2) is replaced by solid bottom roll 46 (FIG. 3) made of iron or steel. The top roll 30 is cooled by water 34 in the same manner as roll 30 described in connection with FIG. 2. For certain applications, sufficient hardening of the thermoplastic contaminants could be achieved with only a single cooled roll. As indicated earlier, thermoplastic contaminants tend to float on the top surface of thin paper and, due to the thinness of the paper, the plastic is likely to at least have an exposed surface that is presented to the top roll 30 (FIG. 3).

Figure 4:
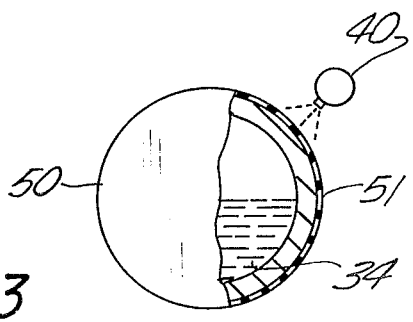
FIG. 4 is an elevational view, partly broken away and in section, of a still further modification wherein the upper roll is liquid cooled and has a rubber cover.

FIG. 4 illustrates a still further embodiment of a hollow top roll 50 which may be used in place of the metallic top rolls 30 shown in FIGS. 2 and 3. Roll 50 is also made of iron or steel but is provided with a rubber cover 51 that forms the working surface of the roll. Roll 50 is also cooled by passing a liquid coolant 34 through the roll; and condensate, if any, is removed by means of an air spray from nozzle 40. The cooled rubber roll 50 could be used with either the cooled bottom roll 32 (FIG. 2) or the uncooled roll 46 (FIG. 3). Since it is difficult to doctor a rubber roll, the doctor blade 36 (FIGS. 2 and 3) would probably not be used with roll 50.

Figure 5:
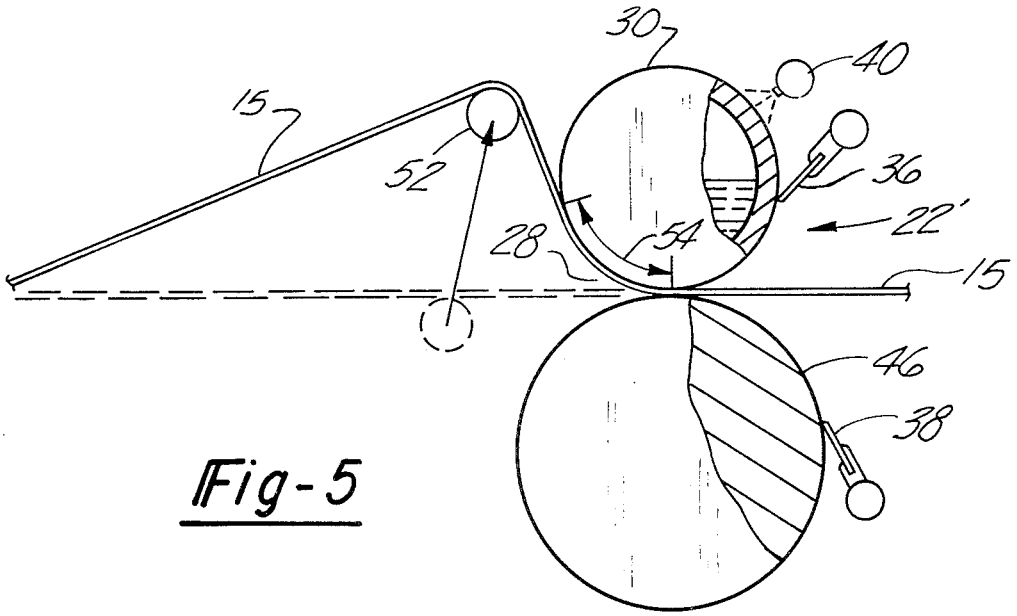
FIG. 5 shows a modification of the present invention at the calender stack for increasing the contact area between the top roll and the paper.

Referring to FIG. 5, the present invention also contemplates a still further modification wherein the paper 15, after it leaves the afterdryer 21 or the dryer 20, as the case may be, passes over a spreader bar 52 and then to the surface of the cooled upper roll 30 before entering nip 28. With this arrangement, it will be apparent that the paper 15 is presented to a larger surface area of the top roll 30 prior to entering nip 28 so as to better cool the thermoplastic in the paper before entering the nip. For example, as illustrated in FIG. 5, the paper 15 engages the surface of roll 30 over a sector 54 of just slightly under 90°. This surface contact in the embodiment of FIG. 5 is thus substantially greater than the surface contact at the nip alone, possibly on the order of 1° or 2° in FIG. 2. The use of a simple spreader bar 52 or other suitable roll to increase the cooled surface area engaging the paper prior to the nip is a very simple and inexpensive modification to an existing paper machine. Preferably, the bar 52 is movable so that it can be lowered to the position illustrated in dotted lines to facilitate threading the paper 15 through the nip 28 and then, once the nip is threaded, the bar would be raised to the position shown in full lines.

Figure 6:
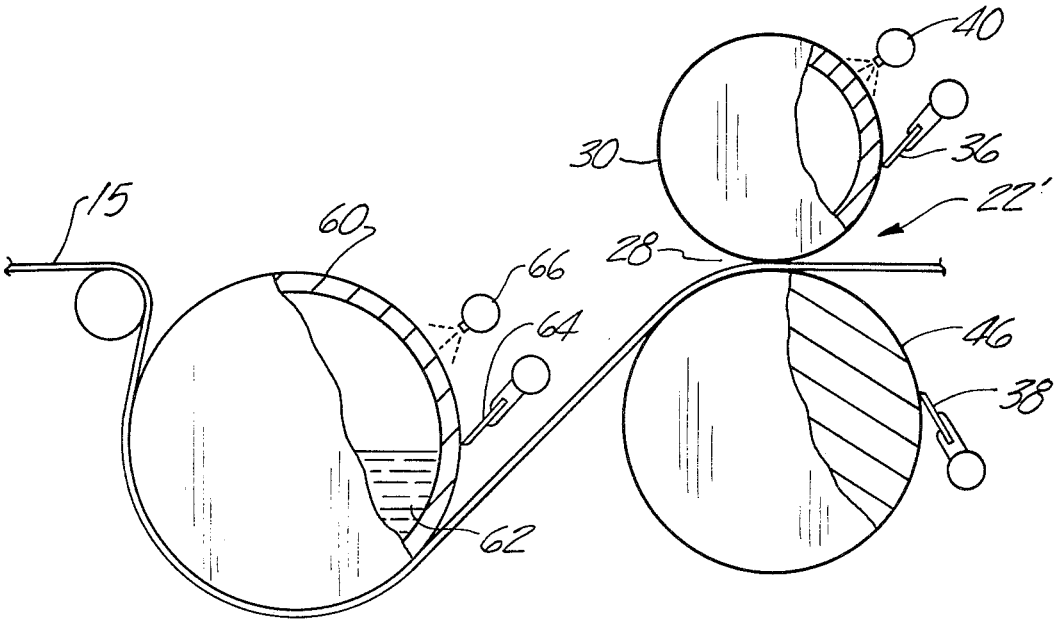
FIG. 6 shows a still further modification to cool the paper prior to entering the calender stack.

FIG. 6 illustrates a still further embodiment of the present invention wherein a larger separate cooling roll 60 is added prior to the calender stack 22'. The paper 15 leaves the afterdryer 21 or the dryer 20, as the case may be, and is cooled at roll 60 so that the thermoplastic contaminants are in a hardened or nonsticky condition before the paper enters nip 28. Drum 60 may be of suitable construction and is chilled by passing liquid coolant 62 therethrough by suitable means (not shown). As with the embodiments in FIGS. 2, 3 and 5, the surface of drum 60 is doctored by blade 64 and air dried by nozzle 66. The temperature of roll 60 would also be in the range of 75° F to 150° F, preferably about 90° F; and at lower temperatures, air drying of roll 60 is important to prevent condensation and hence prevent moisture from being added to the paper.

The present invention contemplates further modifications based on the embodiments of FIGS. 2–6. The stretcher bar 52 (FIG. 5) or the separate cooled drum 60 (FIG. 6) could be used with various arrangements of cooled or uncooled rolls in the calender stack. Where one of the rolls (for example, the top roll 30 in the embodiment shown in FIG. 6) is also a chilled roll, it will be appreciated that the drum 60 could be positioned in a manner similar to the stretcher bar 52 so that the paper passes over the drum 60 and then over a substantial surface area of the cooled top roll before entering the nip.

It will be understood that the method and apparatus for calendering paper containing thermoplastic contaminants have been described hereinabove for purposes of illustration and are not intended to indicate limits of the present invention, the scope of which is defined by the following claims.

I claim:

1. The method of making paper on a paper-making machine of the type having calender rolls and a high-temperature drying section preceding said calender rolls, wherein paper is formed in said machine using pulp made from recycled waste paper, and wherein said pulp contains thermoplastic contaminants in an amount of one percent or less by dry weight, said thermoplastic contaminants having low melting temperatures, comprising drying said paper in said drying section at high temperatures above said melting temperatures such that said paper has a moisture content not greater than substantially 10 percent and such that said paper would be at a temperature on the order of said melting temperatures when said paper is calendered in said calender rolls, calendering said paper at high nip pressures of at least 25 pounds per linear inch in said calender rolls after said paper leaves said drying section, and cooling said thermoplastic contaminants below said melting temperatures after said paper leaves said drying section and before calendering is completed in said calender rolls to reduce the likelihood that said thermoplastic contaminants are in a sticky condition while said paper passes through said calender rolls.

2. The method set forth in claim 1 wherein said thermoplastic contaminants are cooled to a temperature of about 90° F.

3. The method set forth in claim 1 wherein said thermoplastic contaminants are cooled to a temperature in a range of from about 75° F to 150° F.

4. The method set forth in claim 1 wherein said paper is dried so as to have a moisture content no greater than about 5 percent when it is calendered.

5. The method set forth in claim 1 wherein said thermoplastic contaminants are cooled by cooling at least one roll in said calender rolls to a temperature above the dew point of ambient air at said calender rolls.

6. The method set forth in claim 5 wherein said one roll is cooled to a temperature of about 90° F.

7. The method set forth in claim 5 wherein said one roll is cooled to a temperature in a range of from about 75° F to about 150° F.

8. The method set forth in claim 5 wherein said one roll is cooled to a temperature of about 10° F above the dew point of ambient air at said calender rolls.

9. The method set forth in claim 5 wherein said one roll is cooled by passing a liquid coolant through said one roll.

10. The method set forth in claim 5 further comprising doctoring said one roll with a doctor blade while said one roll is rotating to remove any thermoplastic contaminants that adhere to said one roll.

11. The method set forth in claim 5 comprising drying said one roll to remove moisture from a working surface of said one roll.

12. The method set forth in claim 11 wherein said one roll is dried by an air spray.

13. The method set forth in claim 5 wherein said one roll has a working surface formed of a rubber-like material.

14. The method set forth in claim 5 wherein said one roll is metallic.

15. The method set forth in claim 5 wherein said paper moves generally horizontally between a pair of rolls during calendering and wherein said one roll is a top roll that engages an upper surface of said paper as it passes through said pair of rolls.

16. The method set forth in claim 15 wherein said top roll is cooled by passing liquid coolant therethrough.

17. The method set forth in claim 15 wherein the other roll in said pair of rolls is a bottom roll and wherein said bottom roll is also cooled.

18. The method set forth in claim 1 wherein said paper being made has a weight in a range on the order of 9 to 35 pounds per ream.

19. The method set forth in claim 1 wherein said calender rolls have a nip therebetween and wherein said thermoplastic contaminants are cooled before said paper enters said nip.

20. The method set forth in claim 19 wherein said thermoplastic contaminants are cooled by cooling at least one roll in said calender rolls, and wherein said method further comprises engaging said paper with the surface of said one roll prior to said paper entering said nip.

21. The method set forth in claim 20 wherein said paper is engaged with said surface of said one roll over a sector of said surface substantially greater than the contact surface at said nip alone.

22. The method set forth in claim 19 wherein said thermoplastic contaminants are cooled by engaging said paper with the surface of a cooled roll separate from said calender.

23. In the method of making paper from pulp that includes at least some recycled waste paper wherein the pulp is felted into a sheet, the sheet is pressed, dried to a moisture content not greater than 10 percent, and then calendered by a pair of calender rolls and at a nip pressure of at least 25 pounds per linear inch, the improvement wherein said sheet is calendered at a temperature in the range of from about 75° F to 150° F and below that temperature at which thermoplastic contaminants in said recycled waste paper would become sticky and adhere to said calender rolls, said thermoplastic contaminants comprising not more than one percent by weight of said sheet.

24. The method set forth in claim 23 wherein said sheet is dried so as to have a moisture content of not greater than about 5 percent, and wherein one of said rolls is cooled to a temperature of about 10° F above the dew point of ambient air at said rolls so that moisture will not condense on said one roll and moisture will not be added to said sheet during calendering.

25. The method set forth in claim 23 wherein said sheet is cooled before entering said nip.

26. The method set forth in claim 23 wherein said sheet is calendered at a temperature of about 90° F.

27. The method set forth in claim 23 wherein said sheet is calendered in said temperature range by cooling at least one roll in said calender rolls.

28. The method set forth in claim 27 wherein, prior to entering said nip, said sheet is caused to engage a surface of said one roll over a sector of said surface substantially greater than the contact surface at said nip alone.

29. The method set forth in claim 23 wherein said sheet is cooled prior to calendering by engaging said sheet with a surface of a cooled roll separate from said calender rolls.

30. The method set forth in claim 23 wherein said paper being made has a finished weight in a range on the order of 9 to 35 pounds per ream.

* * * * *